US005090897A

United States Patent [19]

Christenson

[11] Patent Number: 5,090,897

[45] Date of Patent: Feb. 25, 1992

[54] UNITIZED BURNER ASSEMBLY

[75] Inventor: Dan L. Christenson, Mulvane, Kans.

[73] Assignee: Gordon-Piatt Energy Group, Inc., Winfield, Kans.

[21] Appl. No.: 518,550

[22] Filed: May 3, 1990

[51] Int. Cl.[5] ..... F23Q 3/00

[52] U.S. Cl. ..... 431/265; 431/183; 239/405

[58] Field of Search ..... 431/265, 183, 186, 189; 239/405, 406; 11/11

[56] References Cited

U.S. PATENT DOCUMENTS

| | | | |
|---|---|---|---|
| 13,387 | 3/1855 | Van Zandt . | |
| 959,057 | 5/1910 | Hanson . | |
| 1,584,210 | 5/1926 | Brunow . | |
| 1,771,623 | 7/1930 | Grayson . | |
| 2,594,797 | 4/1952 | Plass et al. | 431/186 |
| 2,594,914 | 4/1952 | Grosskloss | 158/28 |
| 2,621,722 | 12/1952 | Abrams | 158/114 |
| 2,639,705 | 5/1953 | Lebus | 126/85 |
| 2,658,568 | 11/1953 | Broady | 158/91 |
| 2,667,216 | 1/1954 | Zink et al. | 158/113 |
| 2,956,622 | 10/1960 | Druseikis | 158/99 |
| 3,035,633 | 5/1962 | Palko | 158/68 |
| 3,416,735 | 12/1968 | Reed | 239/567 |
| 3,469,790 | 9/1969 | Duncan | 431/265 |
| 3,885,907 | 5/1975 | Teague, Jr. | 431/328 |
| 4,311,449 | 1/1982 | Young | 431/265 |
| 4,472,136 | 9/1984 | Lefebvre | 431/265 |
| 4,595,355 | 6/1986 | Garrelfs et al. | 431/265 |
| 4,780,077 | 10/1988 | Lefebvre | 431/265 |

FOREIGN PATENT DOCUMENTS

| | | | |
|---|---|---|---|
| 474512 | 9/1952 | Italy . | |
| 354883 | 7/1961 | Switzerland | 431/265 |
| 1183728 | 3/1970 | United Kingdom | 431/183 |
| 1420599 | 1/1976 | United Kingdom . | |

*Primary Examiner*—Carroll B. Dority

*Attorney, Agent, or Firm*—Bill D. McCarthy; Glen M. Burdick

[57] ABSTRACT

A burner assembly for gaseous fuels having an outer housing, a blower and a unitized combustion cartridge. The combustion cartridge comprises an elongated cylinder having a flame holder at a downstream end thereof. The flame holder is provided with a plurality of spatially disposed diffusion plates attached to the cylindrical body of the combustion cartridge such that the center lines of the diffusion plates extend radially and perpendicularly from the cylindrical body. Each plate extends from the cylindrical body at an acute positive angle from the plane of their center lines. A plurality of orifices are disposed in the cylindrical body substantially adjacent the flame holder and a portion of the orifices communicate with orifice extender tubes so that gaseous fuel can be distributed over the upstream surface of the flame holder. The blower, which is pivotally connected to the housing so as to be selectively movable to permit access to the combustion cartridge, impels combustion air around the outside of the cylindrical body of the combustion cartridge, through interstices of the diffusion plates and into a combustion chamber where it is ignited with the gaseous fuels. The angular of disposition of the diffusion plates imparts a swirling motion to the flame, thus assuring efficient and complete combustion.

10 Claims, 3 Drawing Sheets

UNITIZED BURNER ASSEMBLY

BACKGROUND OF THE INVENTION

1. Field of the Invention

The present invention relates generally to gas burners, and more particularly but not by way of limitation, to a unitized burner assembly having a replaceable combustion cartridge.

2. Brief Discussion of the Prior Art

Burners for modern industrial gas furnaces are usually of such size and complexity that good business practice dictates that the burners function continuously over a long period of time without interruption, and when maintenance is required, that repair be completed as quickly as possible. The burners must also operate as efficiently as possible within design constraints such as the assurance of complete combustion and economy of manufacturer.

The prior art is replete with gas burners and gas burner assemblies. Typical of such prior art is U.S. Pat. No. 3,885,907 which discloses an infrared burner having a plurality of orifices. U.S. Pat. No. 3,416,735 discloses a burner assembly for producing radiant heat by discharging gaseous fuel at an angle towards the surface of a ceramic member. U.S. Pat. No. 2,956,622 discloses a horizontal burner having a series of vertically disposed plates which mix the fuel with air and distribute the mixture to the combustion area. U.S. Pat. No. 2,667,216 teaches a burner assembly having a nozzle with orifices for directing a gaseous fuel mixture along the face of a ceramic member to provide a source of radiant heat in a plane substantially parallel to the wall of the furnace in which the burner assembly is mounted.

U.S. Pat. No. 2,621,722 describes a gas burner having a closed end plate axially disposed from the discharge end of a mixing tube. The gas burner also is provided with a plurality of axially spaced discs forming circumferential passageways therebetween to mix and distribute the gaseous fuel mixture. U.S. Pat. No. 2,594,914 discloses a burner having a plurality of burner tips and a plurality of refractory bars upon which flames from the burner tips impinge, thus providing a heat-radiating unit. U.S. Pat. No. 1,771,623 teaches a gas burner with the fuel orifice sealed at point of manufacture to prevent subsequent tampering. U.S. Pat. No. 1,584,210 discloses a gas burner having a conical cap which directs the gaseous fuel flow through a series of circumferential slots so as to reduce the destructive effect of the flame on the end of the burner.

While much advancement has been made in the state of art relating to gas burners, improvements in gas burners are constantly being sought in order to improve the efficiency of operation of the gas burners, as well as to improve the cost of manufacture and maintenance of such burners. It is to such a unitized burner assembly that the present invention is directed.

SUMMARY OF THE INVENTION

The present invention provides an improved unitized burner assembly comprising an outer housing adapted to be fastened to the wall of a furnace or other combustion chamber, a blower and a replaceable unitized combustion cartridge installed within the outer housing. The unitized combustion cartridge comprises an enlongated cylindrical body having a flame holder positioned at the downstream end thereof such that the flame holder projects into the combustion chamber. The flame holder consists of a series of spatially disposed diffusion plates projecting radially and perpendicularly from the cylindrical body; and each of the diffusion plates is connected to the cylindrical body at an acute angle from the plane formed by the intersection of the centerline of the diffusion plate and the circumference of the cylindrical body. A plurality of orifices are provided in the cylindrical body upstream of the flame holder. Orifice extension tubes are attached to the cylindrical body so as to be aligned with and in fluid communication with selected orifices. Thus, gaseous fuel mixture introduced into the burner assembly is distributed to the upstream side of the flame holder and flows to the downstream side of the flame holder through the interstices between the diffusion plates and through the fuel flow orifices provided in the diffusion plates.

An object of the present invention is to provide a unitized burner assembly in which all parts thereof are conveniently accessible and easily removable for maintenance or replacement.

Another object of the present invention, while achieving the before stated object, is to provide a unitized burner assembly which provides optimum integration of gaseous fuel and combustion air, thus assuring maximum operating efficiencies.

Another object of the present invention, while achieving the before stated objects, is to provide a unitized burner assembly which is economical to manufacture and which overcomes the deficiencies of the prior art burner assemblies.

Other objects, features and advantages of the present invention will be apparent from the following detailed description when read in conjuction with the drawings and appended claims.

DESCRIPTION

Figure 1:
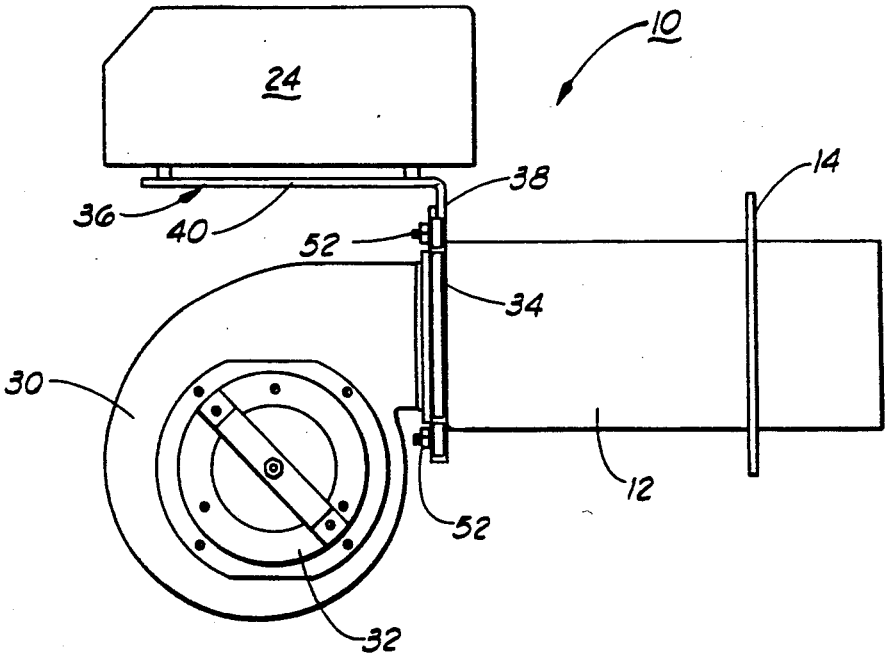
FIG. 1 is a partially detailed side elevational view of a unitized burner assembly constructed in accordance with the present invention.
Figure 2:
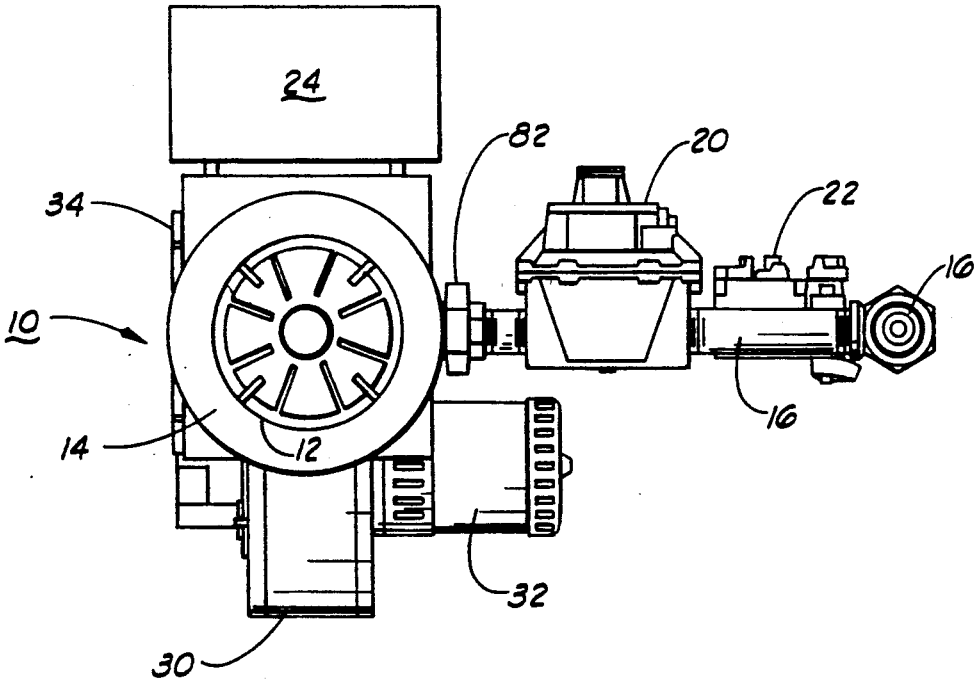
FIG. 2 is a partially detailed front elevational view of the unitized burner assembly of FIG. 1.
Figure 3:
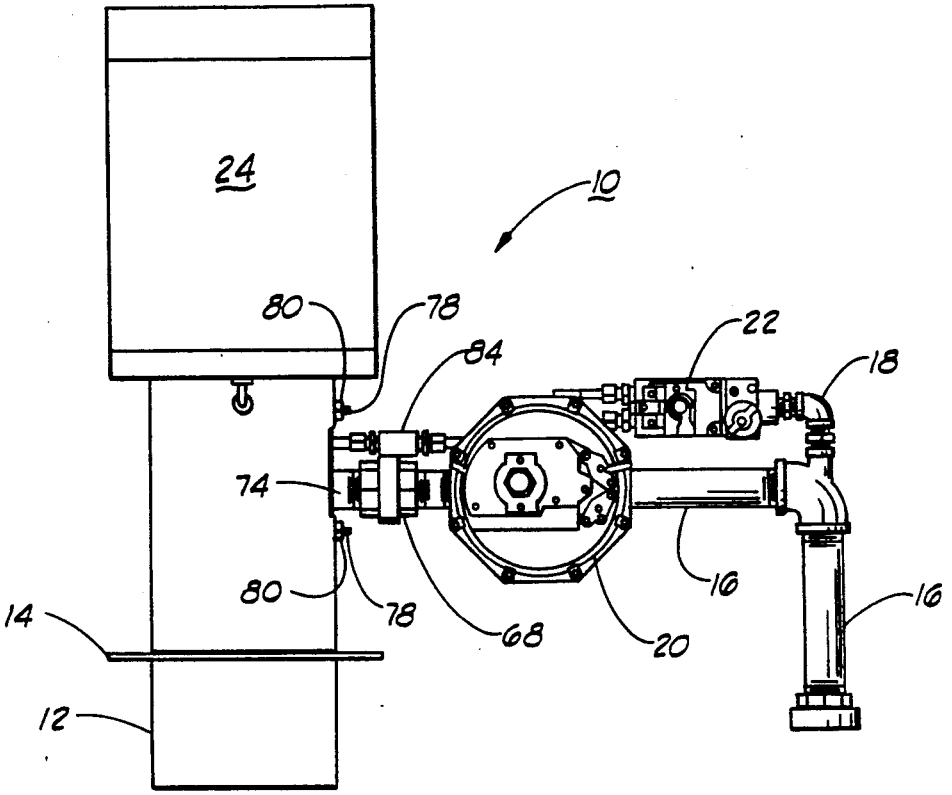
FIG. 3 is a top plan view of the unitized burner assembly of FIG. 1.

Referring now to FIGS. 1 through 3, shown therein is a gas burner 10 constructed in accordance with the present invention. In the interest of clarity, certain components utilizing conventional technology are shown in partial detail, and control wiring is not shown. The gas burner 10 comprises a cylindrical housing 12 and an attachment flange plate 14 for connecting the gas burner 10 to the wall of a furnace or other combustion chamber. Gaseous fuel is introduced into the burner assembly through a fuel supply conduit 16. A pilot light fuel supply conduit 18 communicates with the fuel supply conduit 16 and supplies fuel to a pilot light (not shown). Gas flow from the burner fuel supply conduit 16 and the pilot light fuel supply conduit 18 to the gas burner 10 is controlled by a burner fuel valve 20 and a pilot fuel valve 22. Conventional electrical controls are housed in a control box 24.

Figure 6:
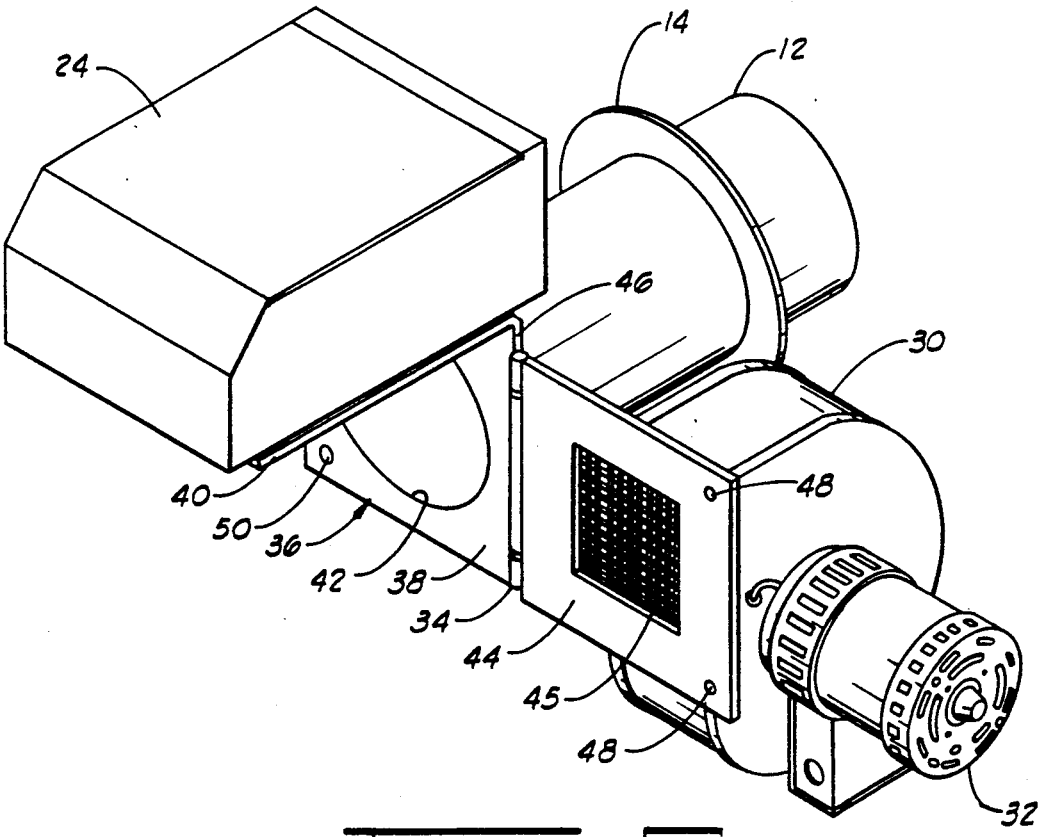
FIG. 6 is a perspective view of the unitized burner assembly of the present invention showing the blower portion thereof pivoted away to permit access to the combustion cartridge.

A blower 30, powered by a blower motor 32, is pivotally mounted on the outer housing 12 by a hinge 34 so that the blower is pivotally movable between a first position (FIG. 1) and a second position (FIG. 6). That is, when the blower 30 is in the first position, the discharge from the blower 30 is axially aligned with the cylindrical outer housing 12; whereas, when the blower 30 is disposed in the second position the blower 30 is pivoted 180° so as to permit access to the combustion cartridge in order to replace or remove components therefrom.

Referring more specifically to FIGS. 1 and 6, the gas burner 10 is further provided with a substantially L-shaped bracket 36 having a first leg 38 and a second leg 40. The first leg 38 (which is disposed adjacent and secured to the cylindrical outer housing 12 by any suitable means, such as welding), is provided with a centrally disposed opening 42 coaxially aligned with the internal bore defined by the cylindrical outer housing 12. The second leg 40, which is substantially normally disposed relative to the first leg 38, extends from the cylindrical outer housing 12 so as to be disposed above the blower 30 when the blower 30 is in the first position substantially as shown in FIG. 1. The control box 24 is supported on and secured to the second leg 40 of the L-shaped bracket 36 by any suitable means, such as with bolts and the like.

The blower 30 is provided with a flange plate 44 having an air discharge opening 45. The flange plate 44 is pivotally connected to edge 46 of the first leg 38 by the hinge 34 in a conventional manner such that the blower 30 can be pivotally moved between the first and second positions. To secure the blower 30 in the first position, the flange plate 44 is provided with a plurality of apertures 48; and the first leg 38 of the L-shaped bracket 36 is provided with a plurality of apertures, such as aperture 50. Thus, when the blower 30 is moved to the first position and the flange plate 44 abuttingly engages the first leg 38, the apertures 48 in the flange plate 44 are aligned with the apertures, in the first leg 38, such as aperture 50. When the blower 30 is secured in the first position the air discharge opening 45 in the flange plate 44 is aligned with the opening 42 formed in the first leg 38 of the L-shaped bracket and thus the passageway defined in the cylindrical outer housing 12. Any suitable means can be employed for connecting the flange plate 42 to the first leg 38 of the L-shaped bracket 36 in order to maintain the blower 30 in the first position, such as by positioning bolts 52 through the aligned apertures 48, 50 in the flange plate 46 and the first leg 38 of the L-shaped bracket 36 substantially as shown in FIG. 1.

Figure 4:
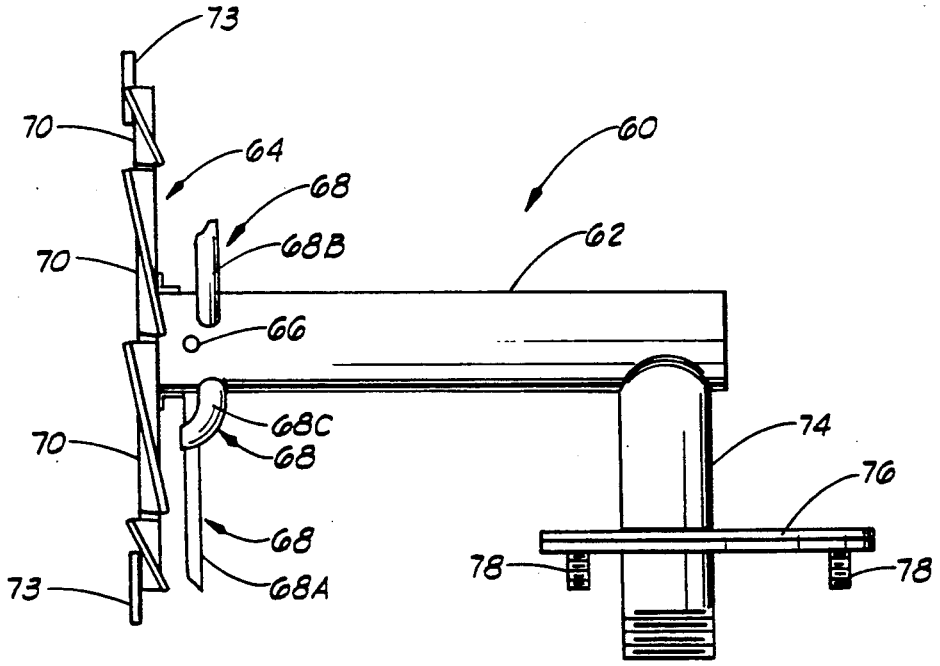
FIG. 4 is a view of a combustion cartridge of the unitized burner assembly of FIG. 1.

Turning now to FIG. 4 shown therein is a elevational view of a unitized combustion cartridge 60 coaxially installed within the outer housing 12. The combustion cartridge 60 comprises a cylindrical body 62 (which is closed at both ends) and a flame holder 64 which is welded to the downstream end of the cylindrical body 62. A plurality of spatially disposed orifices 66 are formed in the cylindrical body 62 substantially adjacent the flame holder 64. A plurality of orifice extension tubes 68 (desirably of varying lengths) are connected to the cylindrical body 62 so that a majority of the orifice extension tubes 68 are aligned with one of the orifices 66 such that the orifice extension tubes 68 extend radially from the cylindrical body 62. In a preferred embodiment there are two sizes of orifices 66 and a plurality of orifice extension tubes 68 of varying lengths. That is, four extension tubes 68A have a first length, four extension tubes 68B have a medium length, or a length less than the length of the extension tubes 68A, and four extension tubes 68C have a length less than the length of the extension tubes 68B. The extension tubes 68 are successively connected to the cylindrical body 62 in a pattern, such as in a repeating order or sequence of: extension tubes 68B—medium length tubes; extension tubes 68A—long extension tubes; extension tubes 68C—short extension tubes; and orifices 66. The sequence, which is repeated about the circumference of the cylindrical body 62, functions to evenly distribute the gaseous fuel through the upstream surface of the flame holder 64.

Figure 5:
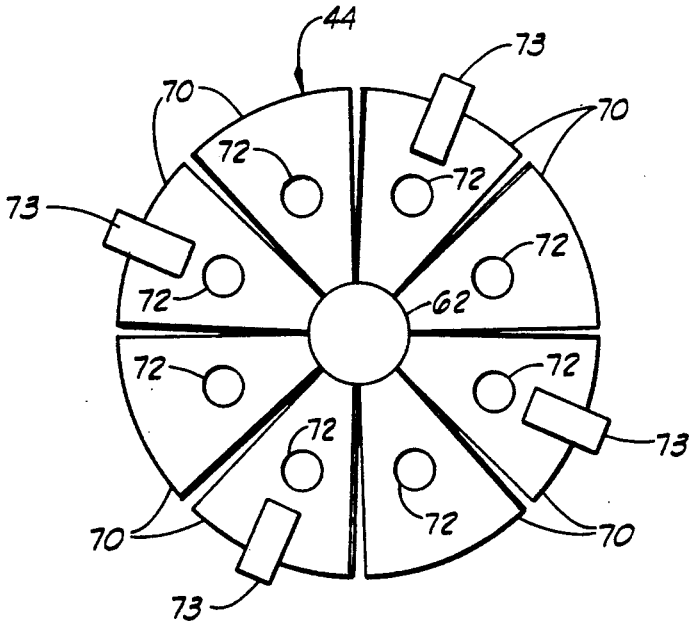
FIG. 5 is a front elevational view of a flame holder which is a component part of the unitized burner assembly of FIG. 1.

Referring now to FIG. 5, the flame holder 44 is illustrated in more detail. The flame holder 44 comprises a plurality of diffusion plates 70 connected to the outer circumference of the cylindrical body 62 by any suitable means, such as welding, so that each of the diffusion plates 70 has its center line extending radially outward in a plane perpendicular to the longitudinal axis of the cylindrical body 62. Each of the diffusion plates 70 is rotated in an acute positive angle from the plane and spatially disposed from each adjacent diffusion plate 70. A flow orifice 72 is positioned in the substantially center portion of each of the diffusion plates 70. The downstream end of the combustion unit cartridge 60 is centered within the outer housing 12 by spacer brackets 73.

Referring now to FIGS. 3 and 4, a burner fuel supply pipe stub 74 extends at a right angle from the upstream end of the cylindrical body 62; and the burner fuel supply pipe stub 74 extends through a mounting plate 76. The mounting plate 76 is curved to substantially correspond to the inside configuration of the cylindrical body 12. Threaded attachment studs 78 are affixed to the mounting plate 76. The studs 78 and the pipe stub 74 protrude through appropriately dimensioned apertures (not shown) in the wall of the mounting plate 76 so that the combustion cartridge 60 can be secured to the outer housing 12 by mounting nuts 80 on the studs 78. The burner fuel pipe stub 74 is connected to the burner fuel valve 20 by a burner fuel supply union 82; and the pilot light (not shown) is connected to the pilot fuel valve 22 by a pilot fuel supply pipe union 84.

In operation, gaseous fuel flows from the supply pipe 16 through the burner fuel valve 20 and into the cylindrical body 62 where the orifice extension tubes 68 (which have varying lengths as indicated by orifice extension tubes 68A, 68B and 68C) distribute gas over the upstream surface of the flame holder 64. Combustion air is impelled by blower 30 along the outside of the cylindrical body 62 to the upstream surface of the flame holder 64, where the combustion air is admixed with the gaseous fuel and the fuel-air mixture flows between the interstices of the diffusion plates 70 and through the flow orifices 72 into the combustion chamber (not shown) for ignition. The angle at which the diffusion plates 70 are affixed to the the cylindrical body 62 imparts a swirling motion to the flame and further mixes the fuel and combustion air, thus assuring efficient and complete combustion.

When it is determined desirable to have access to the unitized combustion cartridge 60 for replacement or repair, the blower 30 is disconnected from the cylindrical outer housing 12 and pivoted 180°. After repair or replacement of the combustion cartridge 60 has been achieved, the blower 30 is pivotally moved to the first position (i.e. the position of alignment with the cylindrical outer housing 12) and secured to the cylindrical outer housing 12 so that the gas burner is again in operative condition. It should be noted that the pivotal attachment of the blower 30 to the cylindrical outer housing 12 provides an improved means for repairing and conducting maintenance of the gas burner 10.

It will be clear that the present invention is well adapted to carry out the objects and attain the advantages mentioned as well as those inherent therein. While a presently preferred embodiment of the invention has been described for the purposes of this disclosure, numerous changes can be made which will readily suggest themselves to those skilled in the art and which are encompassed within the spirit of the invention disclosed and as defined in the appended claims.

What is claimed is:

1. A unitized burner assembly for combustion of gaseous fuels comprising:

an outer housing;

means for supplying fuel through the burner assembly to a combustion chamber;

a replaceable unitized combustion cartridge disposed within the outer housing, the unitized combustion cartridge comprising:

an elongated cylindrical body;

a flame holder connected to a downstream end of the cylindrical body;

a fuel supply pipe stub extending at a right angle from the cylindrical body;

means for distributing gaseous fuel over an upstream surface of the flame holder for admixture with combustion air at the upstream surface of the flame holder; and mounting means for removably connecting the combustion cartridge to the outer housing;

a blower having means for forming an outlet, the blower pivotally connected to the outer housing by a hinge such that the blower can be selectively moved between a first and a second position, in the first position the outlet of the blower being axially aligned with the elongated cylindrical body of the combustion cartridge, in the second position the blower being pivoted for permitting access to the combustion cartridge.

2. A unitized burner assembly for combustion of gaseous fuels comprising:

an outer housing;

means for supplying fuel through the burner to a combustion chamber;

a blower mounted on an upstream end of the outer housing; and a replaceable unitized combustion cartridge disposed within the outer housing, the combustion cartridge comprising:

an elongated cylindrical body having a plurality of orifices disposed near a downstream end thereof;

a flame holder connected to the downstream end of the cylindrical body such that the orifices in the cylindrical body are disposed upstream of the flame holder, the flame holder comprising:

a plurality of spatially disposed diffusion plates connected to the outer circumference of the downstream end of the cylindrical body such that a center line of each of the diffusion plates extends radially and perpendicularly to the longitudinal axis of the cylindrical body, each of the diffusion plates being rotated on its center line in a positive acute angle from the plane extending perpendicularly from the longitudinal axis at the intersection of the center line and the cylindrical body;

a fuel supply pipe stub extending at a right angle from the cylindrical body;

a plurality of extender tubes extending radially from the cylindrical body, each of the extender tubes communicating with one of the orifices in the cylindrical body, the extender tubes and a portion of the orifices cooperating to distribute gaseous fuel over the upstream surface of the flame holder for admixture with combustion air impelled by the blower along the cylindrical body to provide a fuel-air mixture at the upstream surface of the flame holder, the fuel-air mixture flowing into a combustion chamber through interstices between the diffusion plates and flow apertures formed in a medial portion of each diffusion plate, the angular disposition of the diffusion plates imparting a swirling motion to the flame so as to enhance admixing of the gaseous fuel and combustion air; and mounting means for removably connecting the combustion cartridge to the outer housing.

3. A unitized burner assembly for combustion of gaseous fuel comprising:

an outer housing;

means for supplying fuel;

a unitized combustion cartridge supported within the outer housing, the unitized combustion cartridge comprising:

a cylindrical body;

a flame holder connected to a downstream end of the cylindrical body;

a fuel supply pipe stub extending from an upstream end of the cylindrical body;

means supported by the cylindrical body for distributing gaseous fuel over an upstream surface of the flame holder for admixture with combustion air to form a fuel-air mixture along an upstream surface of the flame holder;

means for removably mounting the combustion cartridge to the outer housing; and a blower assembly having means for forming an outlet, the blower assembly pivotally connected to the outer housing so as to be movable between a first position and a second position, in the first position the outlet of the blower axially aligned with the cylindrical body of the combustion cartridge, in the second position the blower pivoted relative to the outer housing so as to permit substantially unrestricted access to the combustion cartridge.

4. The unitized burner assembly of claim 1 wherein the flame holder comprises:

a plurality of spatially disposed diffusion plates connected to the outer circumference of the downstream end of the cylindrical body such that a center line of each of the diffusion plates extend radially and perpendicularly to the longitudinal axis of the cylindrical body, each of the diffusion plates being rotated on its center line in a positive acute angle from the plane extending perpendicularly from the longitudinal axis at the intersection of the center line and the cylindrical body.

5. The burner of claim 2 wherein the extender tubes have varying lengths and wherein the extender tubes and orifices cooperated to form a repetitive pattern about the circumference of a portion of the cylindrical body.

6. The unitized burner assembly of claim 5 wherein the mounting means comprises:

a mounting plate attached to the fuel supply pipe and a plurality of threaded attachment studs, the mounting plate being curved to fit the inside diameter of the outer housing, the threaded attachment studs and the fuel supply pipe extending through appropriately dimensioned holes in the outer housing such that the combustion cartridge can be secured to the outer housing by positioning mounting nuts on the protruding threaded attachment studs.

7. The unitized burner assembly of claim 6 wherein the blower is provided with an outlet, and the blower is pivotally connected to the outer housing by a hinge such that the blower can be selectively moved between a first position and a second position, in the first position the outlet of the blower being axially aligned with the elongated cylindrical body of the combustion cartridge.

8. The unitized burner assembly of claim 3 wherein the flame holder comprises:

a plurality of spatially disposed diffusion plates connected to the outer circumference of a downstream end of the cylindrical body such that a center line of each of the diffusion plates extend radially and perpendicularly to the longitudinal axis of the cylindrical body, each of the diffusion plates being rotated on its center line in a positive acute angle from the plane extending perpendicularly from the longitudinal axis at the intersection of the center line and the cylindrical body.

9. The unitized burner assembly of claim 8 wherein the blower assembly is mounted on an upstream end of the outer housing, wherein the cylindrical body is provided with a plurality of orifices upstream of the flame holder and wherein the means for admixing gaseous fuel with combustion air so as to form a fuel-air mixture along an upstream surface of the flame holder comprises:

a plurality of extender tubes extending radially from the cylindrical body, each of the extender tubes communicating with one of the orifices in the cylindrical body, the extender tubes and a portion of the orifices cooperating to distribute gaseous fuel over the upstream surface of the flame holder for admixture with combustion air and provide the fuel-air mixture at the upstream surface of the flame holder, the fuel-air mixture flowing into a combustion chamber through interstices between the diffusion plates and through flow apertures formed in a medial portion of each diffusion plate, the angular disposition of the diffusion plates imparting a swirling motion to the flame so as to enhance further admixing of the gaseous fuel and combustion air.

10. The unitized burner assembly of claim 9 wherein the mounting means comprises:

a mounting plate attached to the fuel supply pipe and a plurality of threaded attachment studs, the mounting plate being curved to fit the inside diameter of the outer housing, the the threaded attachment studs and the fuel supply pipe extending through appropriately dimensioned holes in the outer housing such that the combustion cartridge can be secured to the outer housing by positioning mounting nuts on the protruding threaded attachment studs.

* * * * *

UNITED STATES PATENT AND TRADEMARK OFFICE

CERTIFICATE OF CORRECTION

PATENT NO. : 5,090,897

DATED : February 25, 1992

INVENTOR(S) : Dan L. Christenson

It is certified that error appears in the above-indentified patent and that said Letters Patent is hereby corrected as shown below:

Cover Page - (56) References Cited, U.S. Patent Documents, after "13,387" delete "3/1855" and substitute therefor -- 3/1912 --;

Column 3, line 7, after "blower" insert --30--;

Column 4, line 2, after "cylindrical body 62" begin a new paragraph; and

Column 4, line 31, after "combustion" delete "unit".

Signed and Sealed this

Twenty-ninth Day of March, 1994

Bruce Lehman

*Attest:*

BRUCE LEHMAN

*Attesting Officer*

*Commissioner of Patents and Trademarks*